US011433685B2

(12) United States Patent
Yourlo et al.

(10) Patent No.: US 11,433,685 B2
(45) Date of Patent: Sep. 6, 2022

(54) LOW-COST INK DELIVERY SYSTEM FOR CONTROLLING INK PRESSURE

(71) Applicant: MEMJET TECHNOLOGY LIMITED, Dublin (IE)

(72) Inventors: Zhenya Yourlo, North Ryde (AU); Andrew Thomas, North Ryde (AU)

(73) Assignee: Memjet Technology Limited

( * ) Notice: Subject to any disclaimer, the term of this patent is extended or adjusted under 35 U.S.C. 154(b) by 0 days.

(21) Appl. No.: 17/180,401

(22) Filed: Feb. 19, 2021

(65) Prior Publication Data

US 2021/0260886 A1 Aug. 26, 2021

Related U.S. Application Data

(60) Provisional application No. 62/980,087, filed on Feb. 21, 2020.

(51) Int. Cl.
*B41J 2/175* (2006.01)
*B41J 2/18* (2006.01)

(52) U.S. Cl.
CPC ..... *B41J 2/17596* (2013.01); *B41J 2/17566* (2013.01); *B41J 2/18* (2013.01)

(58) Field of Classification Search
CPC ..... B41J 2/17596; B41J 2/18; B41J 2/175
See application file for complete search history.

(56) References Cited

U.S. PATENT DOCUMENTS

| | | | |
|---|---|---|---|
| 9,566,797 | B2 | 2/2017 | Nishiyama et al. |
| 2012/0188314 | A1 | 7/2012 | Akiyama et al. |
| 2016/0075144 | A1 | 3/2016 | Sugitani et al. |
| 2016/0089896 | A1 | 3/2016 | Nishiyama |
| 2016/0089897 | A1 | 3/2016 | Nishiyama |
| 2017/0313096 | A1 | 11/2017 | Meyer et al. |

OTHER PUBLICATIONS

International Search Report and Written Opinion of the International Searching Authority dated Apr. 8, 2021, for PCT Application No. PCT/EP2021/050206, filed on Jan. 7, 2021, 11 pages.

*Primary Examiner* — An H Do
(74) *Attorney, Agent, or Firm* — Cooley LLP

(57) ABSTRACT

An ink delivery system for delivering ink to an inkjet printhead. The system includes a first ink tank, a second ink tank, a main air line having an air inlet and an air outlet; a first air line interconnecting the first ink tank and the main air line; a second air line interconnecting the second ink tank and the main air line; an air pump positioned in the main air line; first and second airflow restrictor positioned in the main air line; an ink circulation line interconnecting the first and second ink tanks; and an ink pump positioned in the ink circulation line for pumping ink from the first ink tank to the second ink tank.

16 Claims, 2 Drawing Sheets

LOW-COST INK DELIVERY SYSTEM FOR CONTROLLING INK PRESSURE

CROSS REFERENCE TO RELATED APPLICATIONS

This application claims priority to and the benefit of U.S. Provisional Patent Application No. 62/980,087, entitled LOW-COST INK DELIVERY SYSTEM FOR CONTROLLING INK PRESSURE, filed on Feb. 21, 2020, the disclosure of which is incorporated herein by reference in its entirety for all purposes.

FIELD OF THE INVENTION

This invention relates to an ink delivery system for an inkjet printer. It has been developed primarily for supplying ink to one or more printheads at a relatively constant pressure, as well as lowering the cost of existing circulating ink delivery systems.

BACKGROUND OF THE INVENTION

Inkjet printers employing Memjet® technology are commercially available for a number of different printing formats, including small-office-home-office ("SOHO") printers, label printers and wideformat printers. Memjet® printers typically comprise one or more stationary inkjet printheads, which are user replaceable. For example, a SOHO printer comprises a single user-replaceable multicolored printhead, a high-speed inkjet press comprises a plurality of user-replaceable monochrome printheads aligned along a media feed direction, and a wideformat printer comprises a plurality of user-replaceable printheads in a staggered overlapping arrangement so as to span across a wideformat pagewidth.

Supplying ink to multiple printheads can be problematic as the number of printheads increases. In order to maintain high print quality, each printhead should receive ink at about the same ink pressure from a common ink reservoir.

U.S. Pat. No. 10,252,540, the contents of which are incorporate herein by reference, describes an ink delivery system suitable for a digital inkjet press having multiple printheads in the same color channel. This system uses gross pressure control in a common ink delivery module and local fine pressure control in each print module containing a respective printhead. Due to the high ink flow requirements of multiple inkjet printheads, diaphragm pumps for controlling ink pressure in the ink delivery module are required to be large, high quality pumps. Accordingly, the ink delivery module is necessarily an expensive component of the overall ink delivery system due largely to the high cost of the diaphragm pumps.

For inkjet presses having a small number (e.g. one or two) of print modules in each color channel, an expensive ink delivery module designed for larger systems is undesirable and adds significantly to the overall cost of the system. It would therefore be desirable to provide a low-cost ink delivery system suitable for use in smaller inkjet presses. It would further be desirable to provide a low-cost substitute for the ink delivery module described in U.S. Pat. No. 10,252,540.

SUMMARY OF THE INVENTION

In a first aspect, there is provided an ink delivery system for delivering ink to one or more printheads, the system comprising:

a first ink tank having a first air port, a first ink port for connection to a printhead outlet, an ink refill port for connection to a bulk ink supply and a first ink circulation port;

a second ink tank having a second air port, a second ink port for connection to a printhead inlet and a second ink circulation port;

a main air line having an air inlet and an air outlet;

a first air line interconnecting the first air port and the main air line;

a second air line interconnecting the second air port and the main air line;

an air pump positioned in the main air line between the first and second air lines, the air pump being configured for pumping air from the air inlet towards the air outlet;

a first airflow restrictor positioned between the air inlet and the first air line;

a second airflow restrictor positioned between the air outlet and the second air line;

an ink circulation line interconnecting the first and second ink tanks; and an ink pump positioned in the ink circulation line for pumping ink from the first ink tank to the second ink tank.

The ink delivery system according to the first aspect advantageously controls ink pressure in low and high pressure ink tanks using a single low-cost air pump cooperating with airflow restrictors. The ink delivery system is particularly suitable for use in inkjet printers of the type having one or two monochrome printheads per color channel. In this way, a stable pressure is deliverable to the printhead(s) without the use of costly high-quality diaphragm pumps.

Preferably, the first ink tank is negatively pressurized, and the second ink tank is positively pressurized.

Preferably, a negative ink line is connected to first ink port, a positive ink line is connected to the second ink port and one or more printheads are interconnected between the positive and negative ink lines.

Preferably, each printhead is contained in a print module have local pressure control.

Preferably, the ink delivery system further comprises the bulk ink supply connected to the first ink tank via an ink supply line.

Preferably, the ink delivery system further comprises a refill pump positioned in the ink supply line.

Preferably, the first ink tank has a first ink level sensor and the refill pump is controlled to pump ink from the bulk ink supply to the first ink tank in response to the first ink level sensor sensing a predetermined level of ink in the first ink tank.

Preferably, the second ink tank has a second ink level sensor and the ink pump is controlled to pump ink from the first ink tank to the second tank in response to the second ink level sensor sensing a predetermined level of ink in the second ink tank.

Preferably, the ink delivery system is configured to circulate ink from the second ink tank, through one or printheads and return the ink to the first ink tank.

In a second aspect, there is provided a method of controlling first and second ink pressures in respective first and second ink tanks having respective first and second air lines connected to a main air line, said method comprising the steps of:

actuating an air pump operably connected to the main air line between the first and second air lines; and controlling the first and second ink pressures using first and second airflow restrictors positioned in the main air line, wherein the first airflow restrictor is upstream of the first air line and the second airflow restrictor is downstream of the second air line relative to an airflow direction through the main air line.

Preferably, the first and second airflow restrictors are adjustable.

Preferably, the first and second airflow restrictors are independently controllable.

Preferably, the first and second ink tanks are connected in a fluidic loop containing one or more inkjet printheads.

Preferably, the method includes the step of printing from the printheads.

Preferably, the method includes the step of locally controlling ink pressure in each printhead during printing.

Preferably, the method includes the step of replenishing ink in the second ink tank by pumping ink from the first ink tank to the second ink tank.

Preferably, the method includes the step of replenishing ink in the first ink tank by pumping ink from a bulk ink supply to the first ink tank.

Preferably, the first ink tank is negatively pressurized, and the second ink tank is positively pressurized.

As used herein, the term "ink" is taken to mean any printing fluid, which may be printed from an inkjet printhead. The ink may or may not contain a colorant. Accordingly, the term "ink" may include conventional dye-based or pigment-based inks, infrared inks, fixatives (e.g. pre-coats and finishers), 3D printing fluids and the like. Where reference is made to fluids or printing fluids, this is not intended to limit the meaning of "ink" herein.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
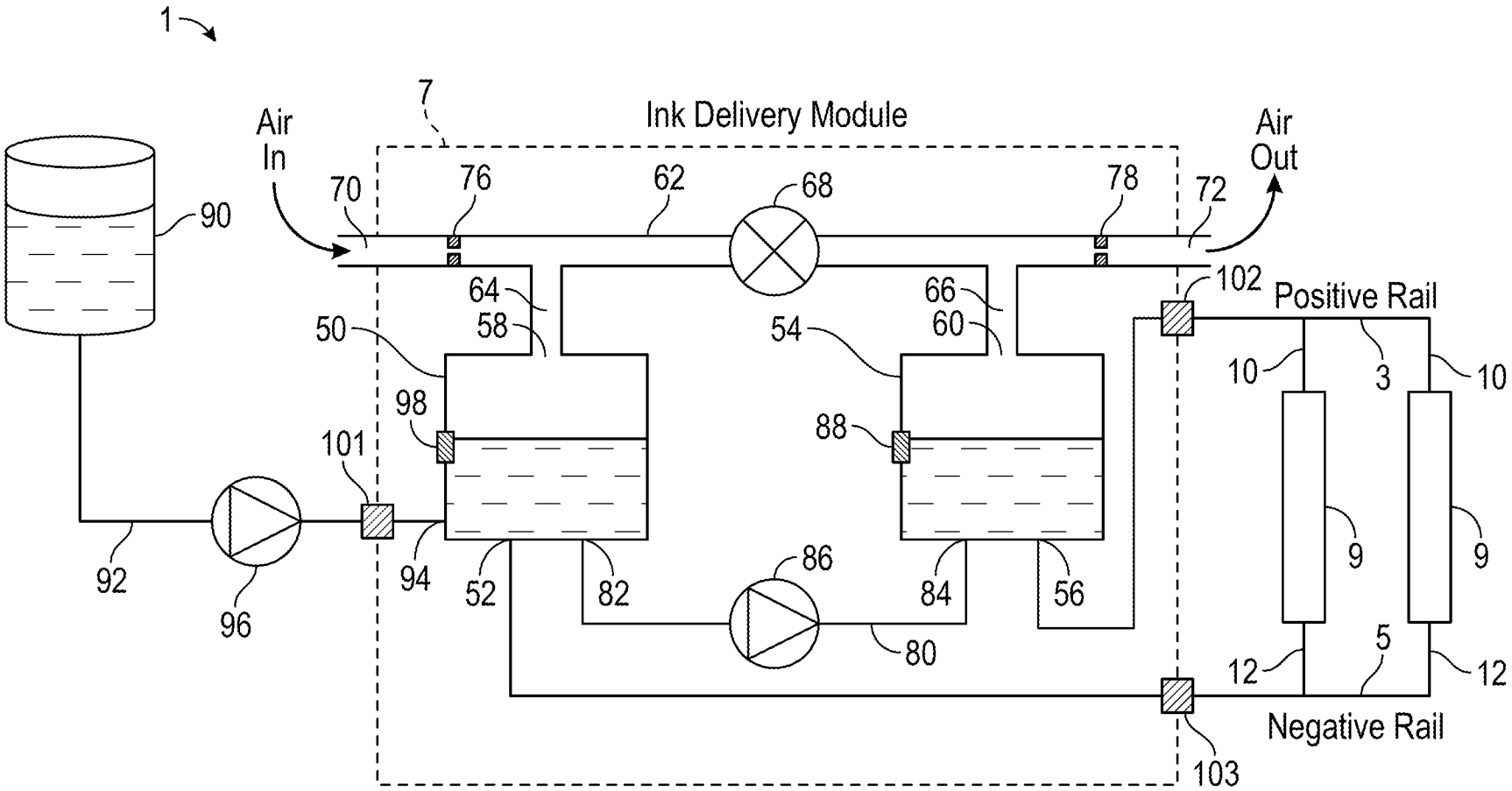
FIG. 1 shows schematically an ink delivery system according to the present invention.

Referring to FIG. 1, there is shown schematically an ink delivery system 1 comprising a positive ink line 3 ("positive rail") and a negative ink line 5 ("negative rail") connected to an ink delivery module 7, which regulates the ink pressure in each of the positive and negative ink lines. A plurality of print modules 9 are interconnected between the positive ink line 3 and the negative ink line 5 via respective inlet and outlet lines 10 and 12. Although two print modules 9 are shown in FIG. 1, it will be appreciated that any number of print modules (e.g. 1, 2 or 3 print modules) may be interconnected between the positive ink line 3 and the negative ink line 5. Print modules 9 may be physically positioned in a staggered overlapping arrangement so as to extend across a print zone media wider than an individual print module. In this way, multiple print modules 9 may be employed for printing onto print media having widths of more than about 8 inches (e.g. at least 16 inches, at least 32 inches or at least 40 inches). Alternatively, or additionally, print modules 9 may be aligned along a media feed path.

Figure 2:
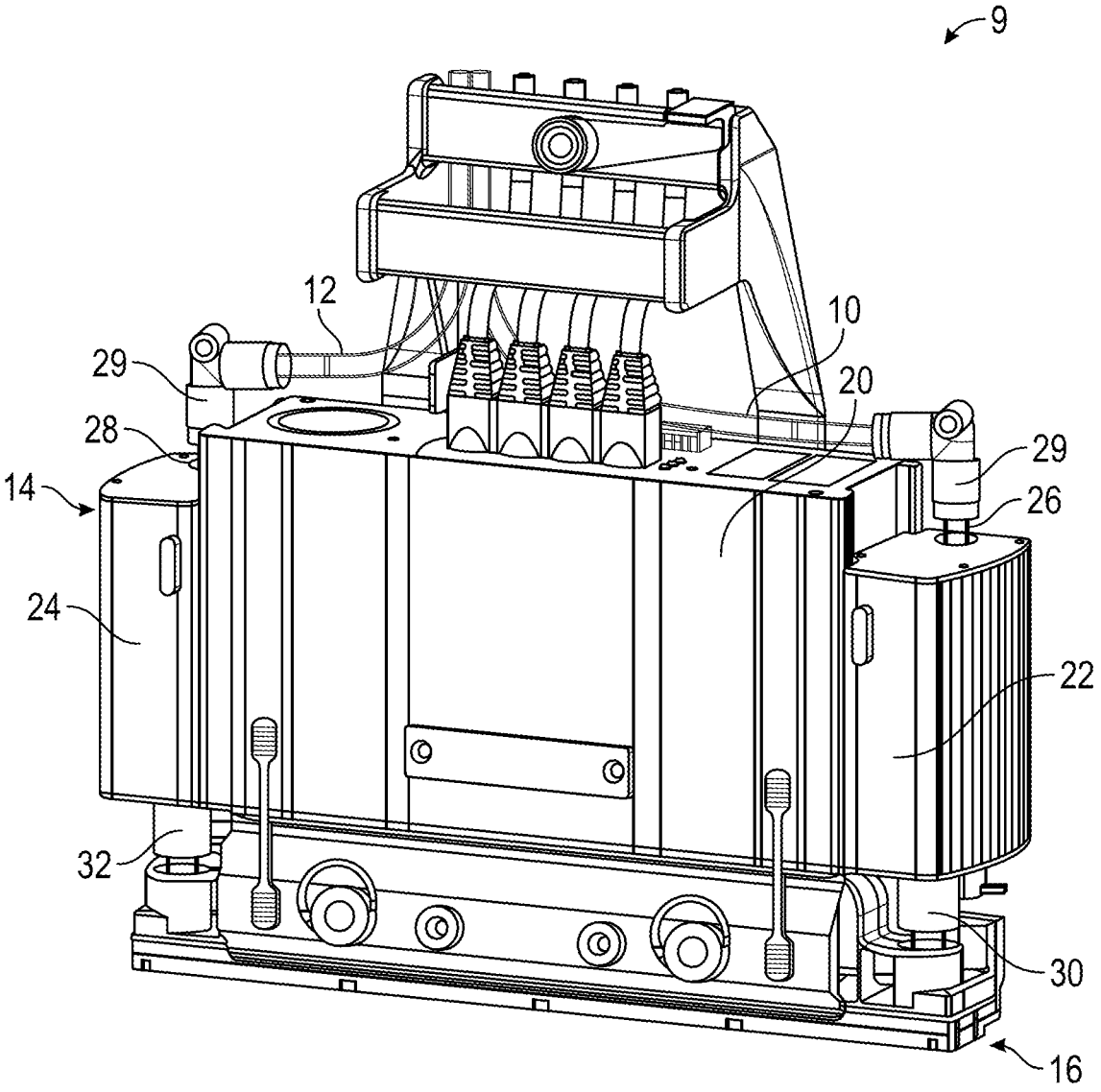
FIG. 2 is a perspective view of a print module.

Referring briefly to FIG. 2, an individual print module 9 is comprised of a supply module 14 and a printhead 16 releasably connected to the supply module. The printhead 16 contains an array of print chips for inkjet printing onto print media and may be a monochrome or color printhead (e.g. two color or four color printhead), as known in the art. For example, the printhead 16 may be of the type described in the U.S. Pat. No. 9,950,527, the contents of which are incorporated herein by reference. In the interests of clarity, an ink delivery system for one color of ink is described herein, although it will be appreciated that multiple ink delivery systems may be used for supply of multiple colors of ink.

The supply module 14 comprises a body 20 housing drive and logic circuitry (e.g. one or more PCBs having a print engine controller chip, drive transistors etc) for the printhead 16, as well as an inlet module 22 and an outlet module 24. The inlet module 22 has a module inlet port 26 connected to the inlet line 10, and the outlet module 24 has a module outlet port 28 connected to the outlet line 12. Suitable print module couplings 29 allow convenient replacement of entire print modules, when required.

The printhead 16 is fluidically connected to the supply module 14 by means of printhead inlet and outlet couplings 30 and 32. The printhead inlet and outlet couplings 30 and 32 are typically quick-connect couplings which enable convenient removal of a spent printhead 16 from each print module 9 and replacement with a new printhead by the user.

The inlet module 22 contains all the necessary components for providing local control of ink pressure in the printhead 16 for a respective print module 9. Thus, each print module 9 provides local, independent control of ink pressure in its respective printhead 16, so that local ink pressures can be fine-tuned automatically and dynamically in response to localized pressure fluctuations. For a detailed explanation of localized pressure control within each print module 9, reference is made to U.S. Pat. No. 10,252,540, the contents of which are incorporated herein by reference.

Returning to FIG. 1, the ink delivery module 7 comprises a first ink tank 50 having a first ink port 52 connected to the negative ink line 5; and a second ink tank 54 having a second ink port 56 connected to the positive ink line 3. The first and second ink tanks 50 and 54 have respective first and second air ports 58 and 60 connected to a common main air line 62 via respective first and second air lines 64 and 66. An air pump 68 is positioned in the main air line 62 between the first and second air lines 64 and 66. The air pump 68 draws in air through an air inlet 70 at one end of the main air line 62 and pumps air through an air outlet 72 at the opposite end. A first (upstream) airflow restrictor 76 is positioned between the air inlet 70 and the first air line 64, while a second (downstream) airflow restrictor 78 is positioned between air outlet 72 and the second air line 66. The first and second airflow restrictors 76 and 78 may be independently adjustable for independent control of airflow therethrough. In some embodiments, the first and second airflow restrictors 76 and 78 may be automatically adjustable under the control of a controller (not shown) for dynamically adjusting ink pressures in response to air or ink pressure sensors (not shown) in the first and second ink tanks 50 and 54.

With the air pump 68 actuated, the first and second airflow restrictors 76 and 78 cooperate to generate a negative head pressure in the first ink tank 50 and a positive head pressure in the second ink tank 54. During printing ink is drawn from the second ink tank 54 via the positive ink line 3, through the print module(s) 9 containing respective printhead(s) 16, and returns to the first ink tank 50 via the negative ink line 5.

Ink consumed from the second ink tank 54 is replenished from the first ink tank 50 via an ink circulation line 80, which interconnects a first ink circulation port 82 of the first ink tank and a second circulation port 84 of the second ink tank. An ink pump 86 (or "lift pump") is positioned in the ink circulation line 80 to lift ink from the negatively-pressurized first ink tank 50 into the positively-pressurized second ink tank 54. Actuation of the ink pump 86 is controlled by means of a controller (not shown), which receives a signal from a second ink level sensor 88 in the second ink tank 54 and actuates the ink pump in response to an ink level in the second ink tank falling below a predetermined level.

The first ink tank 54 is replenished from a bulk ink supply 90 via a supply line 92 interconnecting the bulk ink supply with a refill port 94 of the first ink tank. A refill pump 96 is positioned in the supply line 92 for refilling the first ink tank 50 as ink is consumed therefrom. Actuation of the refill pump 96 is controlled by means of a controller (not shown), which receives a signal from a second ink level sensor 98 in the second ink tank 54 and actuates the refill pump in response to an ink level in the second ink tank falling below a predetermined level.

The ink delivery module 7 is typically a self-contained unit with various external couplings: a supply coupling 101 for connecting the supply line 92; a positive line coupling 102 for connecting the positive ink line 3; and a negative line coupling 103 for connecting the negative ink line 5.

As foreshadowed above, during printing, ink at a regulated positive pressure is supplied to the positive ink line 3. Each print module 9 draws ink from the positive ink line 3 and the ink is fed back to the ink delivery module 7 at a regulated negative pressure via the negative ink line 5. By maintaining control of the relative positive and negative pressures in the positive and negative ink lines 3 and 5, a relatively constant backpressure is provided at each print module 9. Additional local control of backpressure in each printhead 16 may be provided by means of a local pressure controller in each print module 9 (see U.S. Pat. No. 10,252,540).

The air pump 68, which controls head pressure in both the first and second ink tanks 50 and 54 by means of the first and second airflow restrictors 76 and 78, advantageously enables simple pressure control without the use of expensive high-quality diaphragm pumps in the ink delivery module 7. The lift pump 86 may be a relatively inexpensive pump since it is not involved in pressure regulation. Accordingly, the overall cost of the ink delivery module 7 is minimized compared to prior art systems whilst still providing adequate pressure control for, for example, one or two print modules 9.

It will, of course, be appreciated that the present invention has been described by way of example only and that modifications of detail may be made within the scope of the invention, which is defined in the accompanying claims.

The invention claimed is:

1. An ink delivery system for delivering ink to one or more inkjet printheads, the system comprising:

a first ink tank having a first air port, a first ink port for connection to a printhead outlet, an ink refill port for connection to a bulk ink supply and a first ink circulation port;

a second ink tank having a second air port, a second ink port for connection to a printhead inlet and a second ink circulation port;

a main air line having an air inlet and an air outlet;

a first air line interconnecting the first air port and the main air line;

a second air line interconnecting the second air port and the main air line;

an air pump positioned in the main air line between the first and second air lines, the air pump being configured for pumping air from the air inlet towards the air outlet during printing;

a first airflow restrictor positioned between the air inlet and the first air line;

a second airflow restrictor positioned between the air outlet and the second air line;

an ink circulation line interconnecting the first and second ink tanks; and an ink pump positioned in the ink circulation line for pumping ink from the first ink tank to the second ink tank, wherein the first and second air flow restrictors are adjustable during printing, thereby controlling first and second ink pressures in the first and second ink tanks.

2. The ink delivery system of claim 1, wherein the first ink tank is negatively pressurized and the second ink tank is positively pressurized.

3. The ink delivery system of claim 1, wherein a negative ink line is connected to first ink port, a positive ink line is connected to the second ink port and one or more printheads are interconnected between the positive and negative ink lines.

4. The ink delivery system of claim 3, wherein each printhead is contained in a print module have local pressure control.

5. The ink delivery system of claim 3, further comprising a refill pump positioned in the ink supply line.

6. The ink delivery system of claim 5, wherein the first ink tank has a first ink level sensor and wherein the refill pump is controlled to pump ink from the bulk ink supply to the first ink tank in response to the first ink level sensor sensing a predetermined level of ink in the first ink tank.

7. The ink delivery system of claim 6, wherein the second ink tank has a second ink level sensor and wherein the ink pump is controlled to pump ink from the first ink tank to the second tank in response to the second ink level sensor sensing a predetermined level of ink in the second ink tank.

8. The ink delivery system of claim 1 further comprising the bulk ink supply connected to the first ink tank via an ink supply line.

9. The ink delivery system of claim 1, which is configured to circulate ink from the second ink tank, through one or printheads and return the ink to the first ink tank.

10. A method of controlling, during printing, first and second ink pressures in respective first and second ink tanks having respective first and second air lines connected to a main air line, said method comprising the steps of:

actuating an air pump operably connected to the main air line between the first and second air lines; and controlling the first and second ink pressures using first and second airflow restrictors positioned in the main air line; and printing from one or more inkjet printheads, wherein the first airflow restrictor is upstream of the first air line and the second airflow restrictor is downstream of the second air line relative to an airflow direction through the main air line; and the first and second ink tanks are connected in a fluidic loop containing the inkjet printheads.

11. The method of claim 10, wherein the first and second airflow restrictors are adjustable.

12. The method of claim 10, wherein the first and second airflow restrictors are independently controllable.

13. The method of claim 10, further comprising the step of locally controlling ink pressure in each printhead during printing.

14. The method of claim 10, further comprising the step of replenishing ink in the second ink tank by pumping ink from the first ink tank to the second ink tank.

15. The method of claim 10, further comprising the step of replenishing ink in the first ink tank by pumping ink from a bulk ink supply to the first ink tank.

16. The method of claim 10, wherein the first ink tank is negatively pressurized and the second ink tank is positively pressurized.

* * * * *